US005911654A

United States Patent [19]

Webb

[11] Patent Number: 5,911,654

[45] Date of Patent: Jun. 15, 1999

[54] COVER AND CUSHION ENSEMBLE FOR HOSPITAL BED

[76] Inventor: Vernell Webb, 730 Kresson Rd., Cherry Hill, N.J. 08003

[21] Appl. No.: 08/906,680

[22] Filed: Aug. 5, 1997

[51] Int. Cl.[6] ..... A47C 31/00

[52] U.S. Cl. ..... 5/424; 5/425; 5/663

[58] Field of Search ..... 5/424, 425, 663, 5/499; 297/228, 225

[56] References Cited

U.S. PATENT DOCUMENTS

| | | | |
|---|---|---|---|
| 2,641,779 | 6/1953 | Gill | 5/317 |
| 3,742,530 | 7/1973 | Clark | 5/331 |
| 4,081,868 | 4/1997 | Hull | 5/425 |
| 4,827,545 | 5/1989 | Arp | 5/425 |
| 5,003,655 | 4/1991 | Kafai | 5/499 |
| 5,027,456 | 7/1991 | Wadsworth | 5/424 |
| 5,118,553 | 6/1992 | Boisson | 428/99 |
| 5,175,897 | 1/1993 | Marra, Jr. | 5/425 |
| 5,421,046 | 6/1995 | Vande Streek | 5/663 |
| 5,450,641 | 9/1995 | Montgomery | 5/425 |
| 5,481,772 | 1/1996 | Glynn et al. | 5/663 |
| 5,557,817 | 9/1996 | Haddock | 5/663 |
| 5,575,025 | 11/1996 | Peters | 5/482 |

*Primary Examiner*—Michael F. Trettel
*Assistant Examiner*—Fredrick Conley
*Attorney, Agent, or Firm*—Caesar, Rivise, Bernstein, Cohen & Pokotilow, Ltd.

[57] ABSTRACT

A cover and cushion ensemble for a hospital bed that improves the bed's aesthetic appearance while the bed is being used for its intended purpose and also converts the bed into a sofa or some other covered seat that is functional and aesthetically pleasing when the bed is not being used for its intended purpose. The cover and cushion ensemble comprises a side rail cushion, a head board cover, a foot board cover, a mattress cover and a side rail cover. The side rail cushion and the side rail cover are each shaped to hide the bed's safety side rails from view. The side rail cushion is provided with fastening means for releasable securement to the bed's safety side rail. The head board and foot board covers are both formed of a flexible sheet material and are arranged to be fitted over the bed's head board and foot board, respectively to hide them from view. The mattress cover is also formed of a flexible sheet material and is arranged to be fitted over the bed's mattress. The mattress cover is provided with fastening means for removably engaging cooperating fastening means located on the head board and foot board covers to provide a neat appearance.

9 Claims, 5 Drawing Sheets

FIG. 5
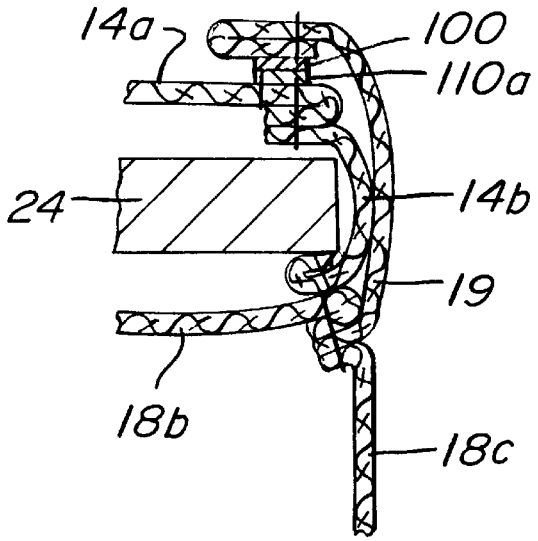
FIG. 6
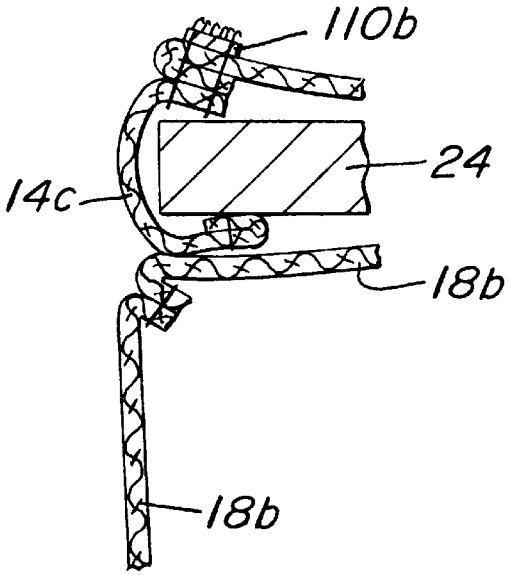
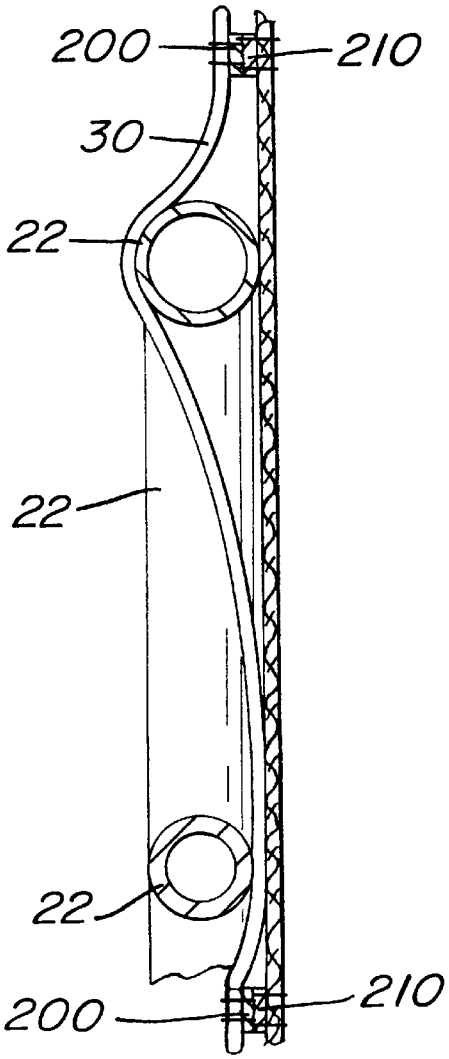
FIG. 8

FIG. 9
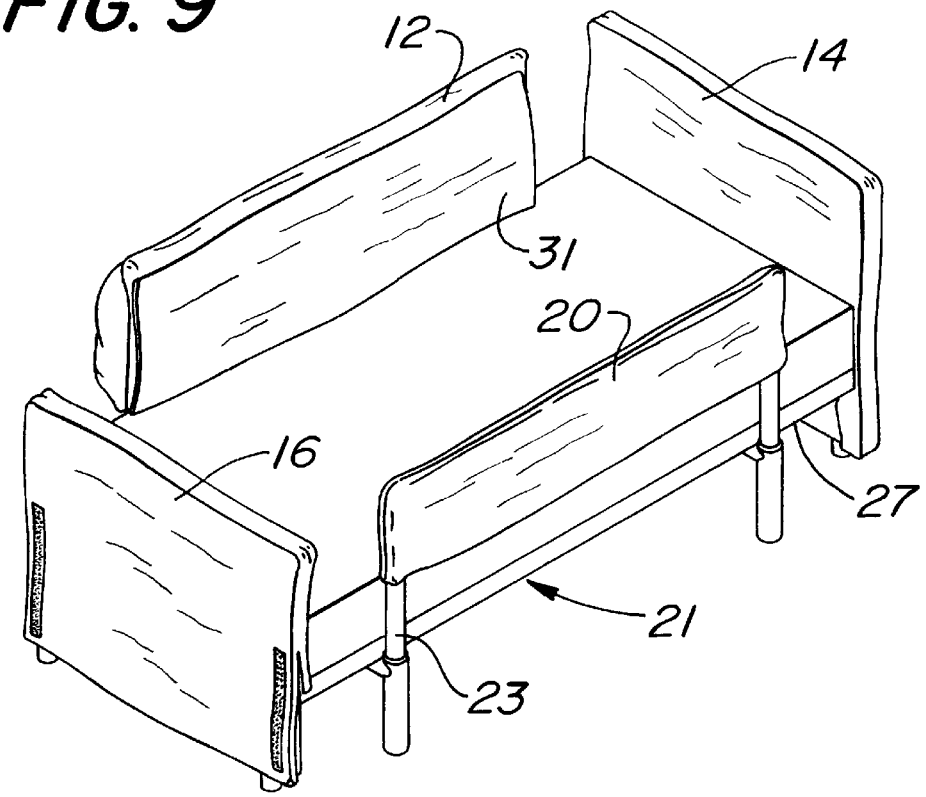
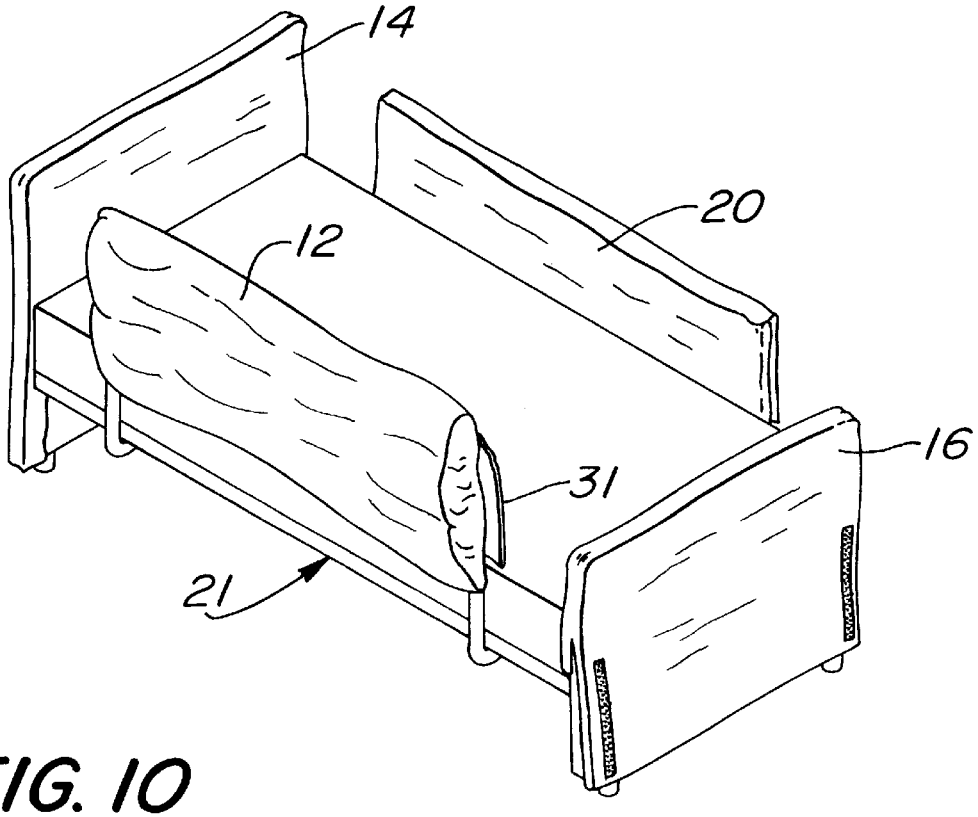
FIG. 10

COVER AND CUSHION ENSEMBLE FOR HOSPITAL BED

BACKGROUND OF THE INVENTION

Beds utilized in hospitals and other health care facilities are typically designed with emphasis placed upon optimizing durability and functionality. Often, less attention is paid to aesthetic considerations in the event it becomes necessary to utilize a hospital bed in a patient's private residence. Such need to utilize a hospital bed in a patient's residence may arise where a patient is recovering at home from surgery or has suffered a debilitating illness, e.g., heart attack or stroke. Other circumstances may warrant the use of a hospital bed in a patient's residence.

In fact, as hospital costs have escalated, the practice of providing patients with hospital rooms and facilities for the purpose of recovery after medical procedures has become prohibitively expensive, forcing many hospitals to reexamine this practice and consider alternatives. One alternative that has been implemented in recent years is the practice of discharging patients from the hospital within a short period of time, e.g., within a few days of a procedure, to return home to recover. In accordance with this practice, all of the facilities, e.g., hospital bed, nursing care, etc., that are necessary to enable recovery are provided to the patient at his or her private residence rather than in the hospital.

Often, the presence of a hospital bed in a person's private residence can be emotionally upsetting to the patient and his or her loved ones and close friends. It would be a significant advancement in the art to provide an ensemble of decorative components for covering various parts of an otherwise unattractive hospital bed during use by a patient when sleeping. It would also be a significant advancement in the art to provide an ensemble of decorative components for covering various parts of the hospital bed when the bed is not being used for sleeping so as to convert the hospital bed into a sofa or some other covered seat that is functional and aesthetically pleasing and more suited for placement in the home.

There have been numerous suggestions in the prior art of providing covers for various parts of a bed, some covers being decorative in nature. For example, U.S. Pat. No. 2,641,779 (Gill) discloses a decorative cover for a head board formed of a fabric. U.S. Pat. No. 5,118,553 (Boisson) discloses a decorative bed covering having a pair of releasably securable panels. One of the panels comprises a mattress cover in the form of a blanket. The other panel comprises a fitted cover to enclose a pillow. The fitted cover is arranged to be releasably secured to the blanket via hook and loop type fasteners. Several other patents disclose covers for safety rails of a hospital bed, e.g., U.S. Pat. No. 3,742,530 (Clark); U.S. Pat. No. 5,175,897 (Marra); and, U.S. Pat. No. 5,575,025 (Peters).

While all of the aforementioned patents seem suitable for their intended purposes, none of them provide a complete ensemble of decorative components for covering various parts of a hospital bed while the hospital bed is being used for its intended purpose, i.e., providing a level support surface on which a patient sleeps. Moreover, none of the aforementioned patents provide a complete ensemble of decorative components for covering various parts of a hospital bed during the time the hospital bed is not being used by a patient for sleeping to convert the hospital bed into a sofa or some other covered seat. Conversion of the hospital bed in this manner will result in an aesthetically pleasing appearance that will promote use of the hospital bed in a home environment. Moreover, conversion of the hospital bed in this manner will provide added capability in enabling the hospital bed to function as a sofa or a covered seat.

OBJECTS OF THE INVENTION

Accordingly, it is a general object of this invention to provide a cover and cushion ensemble for a hospital bed which overcomes the disadvantages of the prior art.

It is a further object of this invention to provide a cover and cushion ensemble for a hospital bed that is inexpensive to manufacture.

It is a further object of this invention to provide a cover and cushion ensemble for a hospital bed that is reliable in operation.

It is a further object of this invention to provide a cover and cushion ensemble for a hospital bed that is simple in construction.

It is a further object of this invention to provide a cover and cushion ensemble for a hospital bed that is neat and decorative and provides an aesthetically pleasing appearance.

It is a further object of this invention to provide a cover and cushion ensemble for a hospital bed that covers the various components of the hospital bed, e.g., the head board, the foot board, the mattress and the safety rails.

It is a further object of this invention to provide a cover and cushion ensemble for a hospital bed that comprises a plurality of components that readily attach to a hospital bed without any requisite training or experience.

It is a further object of this invention to provide a cover and cushion ensemble for a hospital bed that comprises a plurality of components that will enable the hospital bed to function as a sofa or some other covered seat.

It is a further object of this invention to provide a cover and cushion ensemble for a hospital bed for use when the hospital bed is being used for its intended purposes, i.e., bed rest and sleep, and also for use when the hospital bed is not being used for those intended purposes to convert the hospital bed into a sofa or some other aesthetically pleasing covered seat.

SUMMARY OF THE INVENTION

These and other objects of this invention are achieved by providing a cover and cushion ensemble for a hospital bed that improves the bed's aesthetic appearance while the bed is being used for its intended purpose and also converts the bed into a sofa or some other covered seat that is functional and aesthetically pleasing when the bed is not being used for its intended purpose. The hospital bed, on which the ensemble is intended for use, is of the type having a head board, a foot board, a mattress and side rails, the side rails being moveable between a lowered position for facilitating patient ingress and egress and a raised position for preventing a patient from inadvertently falling out of the hospital bed. The side rails operate independently of one another. The cover and cushion ensemble comprises a side rail cushion, a head board cover, a foot board cover, a mattress cover and a side rail cover. The side rail cushion and the side rail cover are each shaped to hide the bed's safety side rails from view. The side rail cushion is provided with fastening means for releasable securement to the bed's safety side rail. The head board and foot board covers are both formed of a flexible sheet material and are arranged to be fitted over the bed's head board and foot board, respectively to hide them from view. The mattress cover is also formed of a flexible sheet material and is arranged to be fitted over the bed's mattress. The mattress cover is provided with fastening means for removably engaging cooperating fastening means located on the head board and foot board covers to provide a neat appearance.

DESCRIPTION OF THE DRAWINGS

Other objects and many attendant features of this invention will become readily appreciated as the same becomes better understood by reference to the following detailed description when considered in connection with the accompanying drawings wherein:

FIG. 5 is an enlargement of an area shown in FIG. 4 that is encircled by a line labelled FIG. 5;

FIG. 6 is an enlargement of an area shown in FIG. 4 that is encircled by a line labelled FIG. 6;

FIG. 8 is an enlargement of an area shown in FIG. 7 that is encircled by a line labelled FIG. 8;

FIG. 9 is a third isometric view of the preferred embodiment of the cover and cushion ensemble of the present invention illustrating selected decorative components of the ensemble assembled to the hospital bed when the bed is being utilized as a hospital bed rather than as a sofa; and, FIG. 10 is a fourth isometric view of the preferred embodiment of the cover and cushion ensemble of the present invention also illustrating selected decorative components of the ensemble assembled to the hospital bed when the bed is being utilized as a hospital bed rather than as a sofa.

DETAILED DESCRIPTION OF THE PREFERRED EMBODIMENTS

Figure 1:
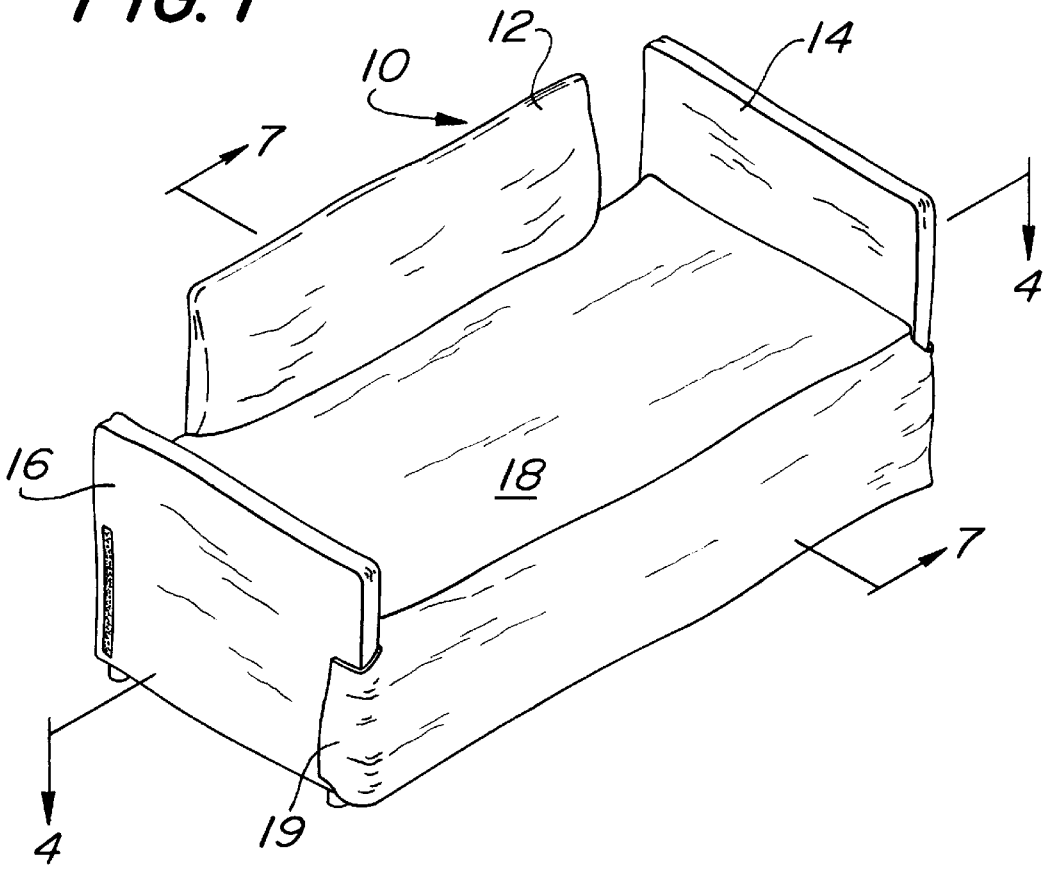
FIG. 1 is an isometric view of the preferred embodiment of the cover and cushion ensemble of the present invention positioned over the various components of a hospital bed.
Figure 2:
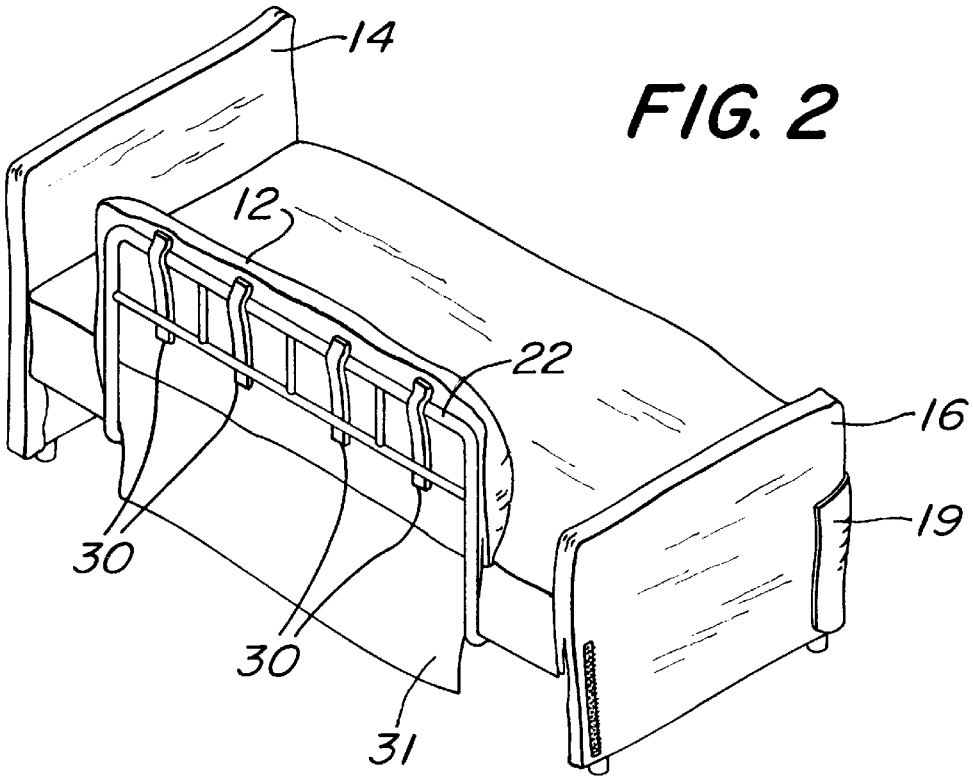
FIG. 2 is a second isometric view of the preferred embodiment of the cover and side rail cushion ensemble of the present invention illustrating the manner in which the cushion attaches to a safety side rail.
Figure 3:
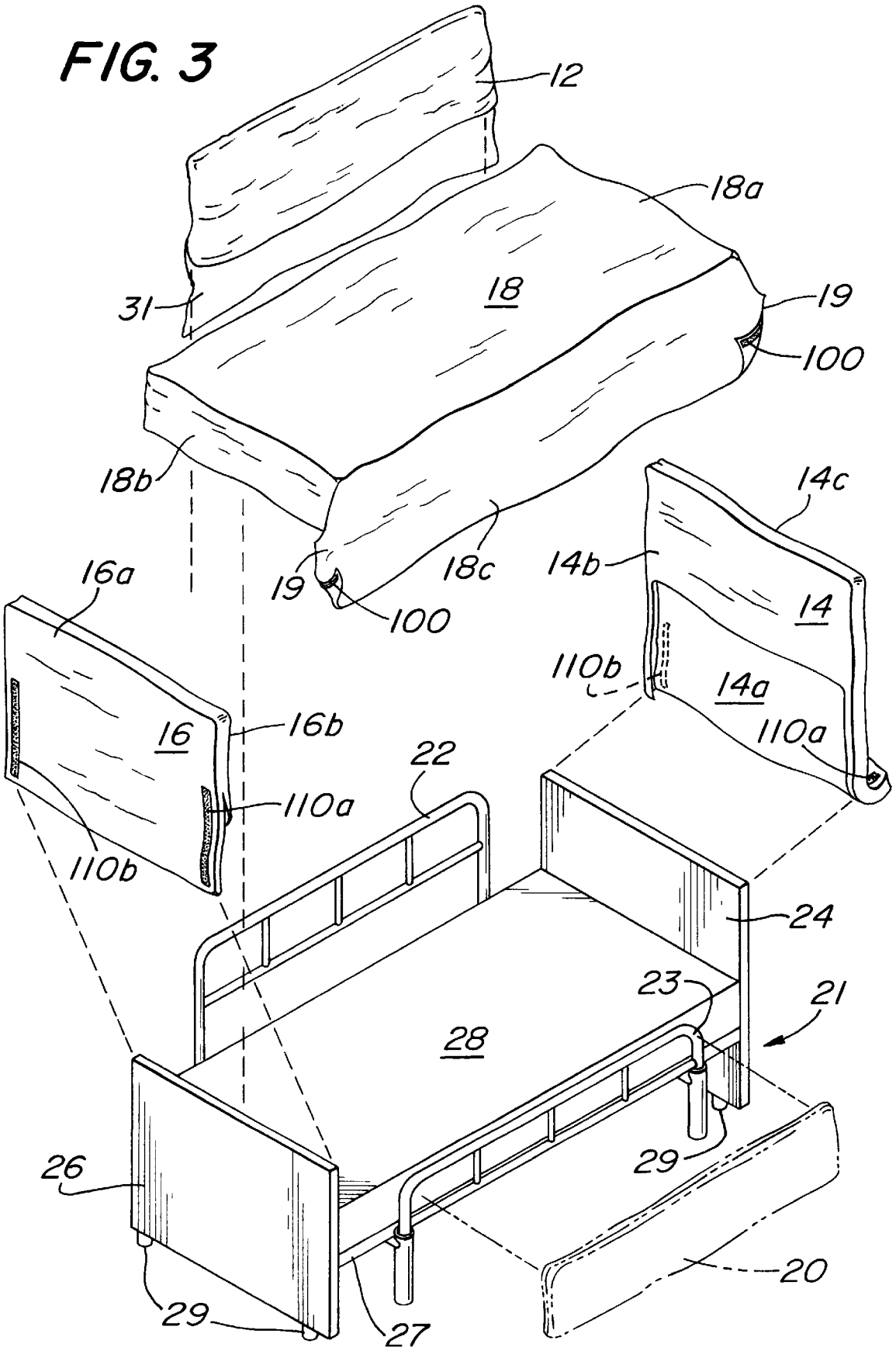
FIG. 3 is an exploded isometric view of the decorative components comprising the cover and cushion ensemble of the present invention which may be assembled to the hospital bed shown therein.
Figure 4:
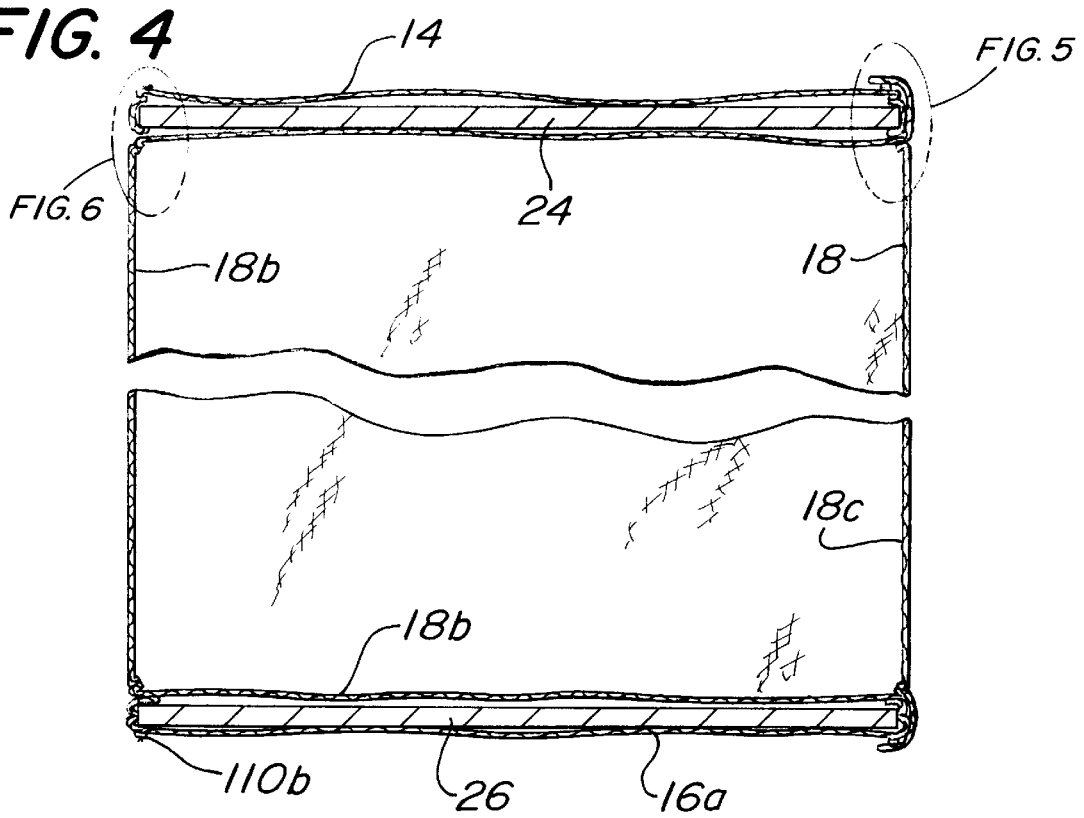
FIG. 4 is a sectional view taken along line 4—4 of FIG. 1.

Referring now in greater detail to the various figures of the drawings wherein like reference numerals refer to like parts there is shown at 10 in FIGS. 1 and 2, the preferred embodiment of the cover and cushion ensemble for a hospital bed constructed in accordance with this invention. Referring now to FIG. 3, the hospital bed 21 to which the ensemble 10 attaches is shown as having a head board 24, a foot board 26, opposed safety side rails 22 and 23, a bed frame 27 and a mattress 28 positioned on the bed frame 27. The head board 24 and foot board 26 are each provided with feet 29. The safety side rails 22 and 23 are typically formed of a rigid framework of metal tubing and are arranged to be moved independently of one another by a nurse or other attendant. The safety side rails 22 and 23 are arranged to be moved between a lowered position for facilitating patient ingress and egress and a raised position wherein the safety side rail may be locked in order to prevent a patient from inadvertently falling out of the bed.

The details of the cover and cushion ensemble 10 will be described later. Suffice it for now to say that the preferred embodiment of the cover and cushion ensemble 10 basically comprises five components: a side rail cushion 12, a head board cover 14, a foot board cover 16, a mattress cover 18 and a side rail cover 20.

It is important to mention at this juncture that under the present invention, decorative components comprising the ensemble 10 of the present invention are intended to be assembled to the hospital bed 21 for improving the bed's aesthetic appearance while the bed is being used for its intended purpose, i.e., providing a level supporting surface on which a patient sleeps, and also when the bed is not being used for that purpose. In particular, when the bed is not being used for its intended purpose, decorative components comprising the ensemble 10 may be used to convert the hospital bed into a sofa or some other covered seat that is functional and aesthetically pleasing and more suited for placement in the home.

As best shown in FIGS. 9 and 10, when the hospital bed is being utilized for its intended purpose, i.e., providing a level support surface on which a patient sleeps, decorative components of the ensemble 10 may be assembled to the bed 21 to improve its aesthetic appearance, i.e., the head board cover 14, the foot board cover 16, the side rail cushion 12 and the side rail cover 20.

As best shown in FIGS. 1, 2 and 3, when the bed 21 is not being used for its intended purpose, decorative components comprising the ensemble 10 may be utilized to convert the hospital bed 21 into a sofa or other covered seat that is functional, aesthetically pleasing and more suited for placement in the home. In the preferred embodiment, the head board cover 14, the foot board cover 16, the mattress cover 18 and the side rail cushion 12 are the decorative components of the ensemble that are assembled to the bed 21 when the ensemble is being utilized to convert the bed 21 to a sofa in this manner. In an alternative embodiment (not shown in the drawings), decorative components of the ensemble including the head board cover 14, the foot board cover 16 and the mattress cover 18 are assembled to the bed. Stated differently, under this alternative embodiment, the side rail cushion 12 is not assembled to the bed 21.

What follows is a detailed description of the various decorative components of the ensemble 10 that are assembled to the hospital bed 21 to convert the bed to a sofa. Referring now to FIG. 3, the headboard cover 14 is formed of a multi-panel construction including an outer panel 14*a*, an inner panel 14*b*, and an intermediate edge panel 14*c*. The various panels are held together along their respective edges by stitching. The width of panels 14*a* and 14*b* is slightly larger than the width of the head board 24 and the width of panel 14*c* is slightly larger than the thickness of the headboard 24 to provide a snug fit of the head board cover 14 over the head board 24 of the hospital bed. As shown in FIG. 3, when the head board cover 14 is placed over the head board 24, the outer panel 14*a* and edge panel 14*c* are sized to extend to the floor while the inner panel 14*b* is cut out to extend down to the mattress 28 and no further in order to maximize coverage of the head board 24, hiding it from view, while providing a relatively close fit.

Referring again to FIG. 3, the foot board cover 16 is formed of a multi-panel construction including an outer panel 16*a*, an inner panel 16*b* and an intermediate edge panel 16*c*. The various panels are held together along their respective edges by stitching. The width of panels 16*a* and 16*b* is slightly larger than the width of the foot board 26 to provide a snug fit of the foot board cover 16 over the foot board 26 of the hospital bed. As best shown in FIG. 3, when the foot board cover 16 is placed over the foot board 26, the outer panel 16*a* and intermediate edge panel 16*c* are sized to extend to the floor while the inner panel 16*b* is cut out to extend down to the mattress 28 and no further in order to maximize coverage of the foot board 26, hiding it from view, while providing a relatively close fit.

Referring again to FIG. 3, the mattress cover 18 is formed of a top panel 18*a* arranged for covering the top surface of the mattress 28. Sewn to the top panel 18*a* is a peripheral panel 18*b* that surrounds and covers two sides and the rear of the mattress 28. Also sewn to the top panel 18*a* is a front skirt panel 18*c* that extends downwardly from the mattress and nearly reaches the floor. As best shown in FIGS. 1, 2, 3 and 5, the front skirt panel 18*c* is provided with a pair of flaps 19 at opposed ends that extend laterally. A vertically oriented hook component 100 of a fastening system, e.g., the type marketed under the name VELCRO, is fastened, e.g., sewn, to the inner surface of each flap 19. It should be appreciated that other fastening means are also envisaged in accordance with this invention, e.g., buttons or cooperating snap members.

The lower portion of the outer panel 14*a* of the head board cover 14 is provided with a vertically disposed cooperating loop component 110*a* so that the front skirt panel 18*c* of the mattress cover 18 may be stretched and held tightly against the head board cover 14 by fastening hook component 100 to the cooperating loop component 100*a*. Likewise, the lower portion of the outer panel 16*a* of the foot board cover 16 is provided with a vertically oriented cooperating loop component 110*a* so that the front skirt panel 18*c* of the mattress cover may be held tightly against the foot board cover 16 by fastening hook component 100 to the cooperating loop component 110*a*. Joinder of the head board cover 14 to the mattress cover 18 and joinder of the foot board cover 16 to the mattress cover 18 in this manner provides for a unitary and continuous appearance that contributes to converting the bed's appearance from that of a hospital bed to that of a sofa or some other covered seat that is aesthetically pleasing and more suited for placement in the home.

Second loop components 110*b* are provided on the outer panel 14*a* of the head board cover 14 and on the outer panel of the foot board cover 16 in the event it is desired to rotate the mattress cover 18 one-hundred eighty degrees with respect to the head board cover 14 and the foot board cover 16. The second loop components 110*b* add flexibility for use of the ensemble 10 when considering options for placement of the hospital bed within a residential bedroom.

Figure 7:
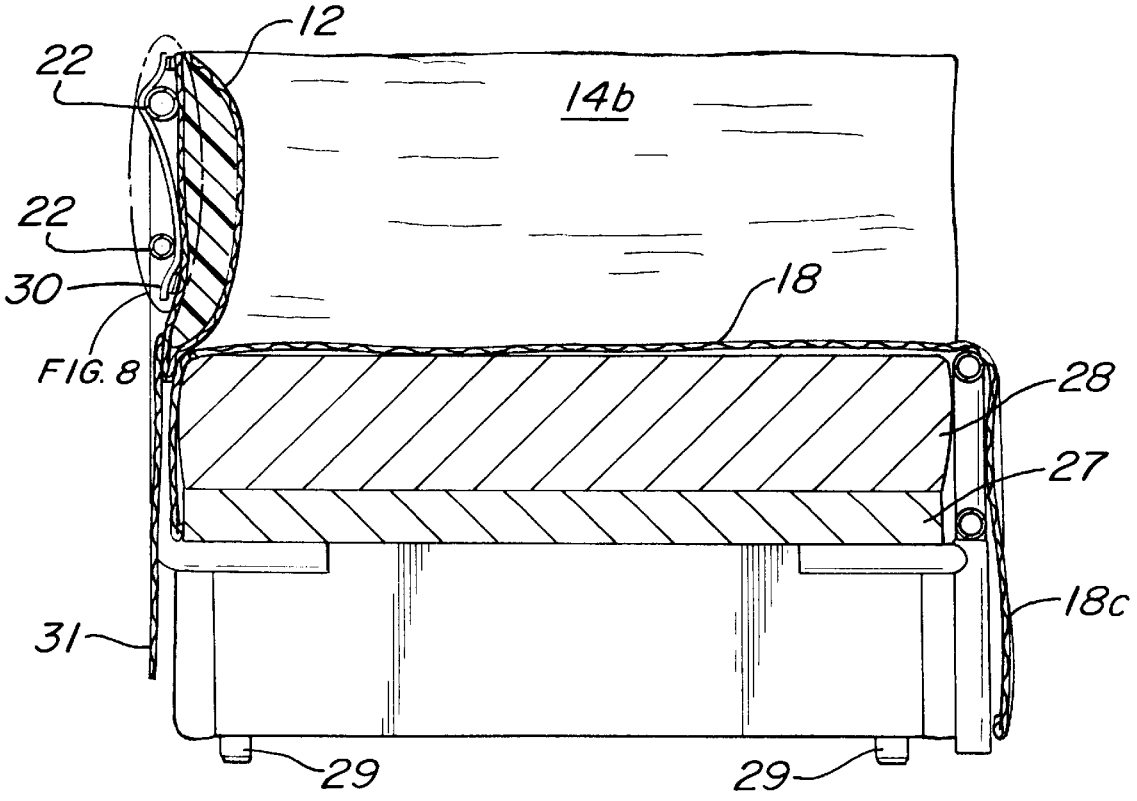
FIG. 7 is a sectional view taken along line 7—7 of FIG. 1.

As best shown in FIG. 7, the side rail cushion 12 is constructed in the form of a large pillow case having a closed end and an open end for the insertion of pillows or other means for stuffing the side rail cushion 12. The side rail cushion 12 is stuffed to obstruct the safety side rail 22 from view and achieve an aesthetically pleasing appearance of a cushion that would appear on a sofa or some other covered seat that is suited for placement in the home.

Referring now to FIG. 2, 7 and 8, the side rail cushion 12 is positioned against the safety side rail 22 and attaches thereto by means of a plurality of fabric strips 30. As best shown in FIG. 8, hook components 200 of a fastening system, e.g., VELCRO, are fastened, e.g., sewn, at opposite ends of each fabric strip 30. Cooperating loop components 210 are provided on the side rail cushion 12 to enable securement of the side rail cushion 12 to the safety side rail 22.

Referring now to FIGS. 2 and 7, the side rail cushion 12 is shown as being positioned on the inside of the safety side rail 22 and located above of the mattress 28. Further, the side rail cushion 12 is shown in these figures as being attached to the upper rail but not the lower rail of the safety side rail 22 by means of the elongated fabric strips 30. As previously mentioned, when the side rail cushion 12 is positioned in this manner, it provides an aesthetically pleasing appearance. Moreover, when positioned in this manner the side rail cushion 12 enables the bed to actually function as a sofa in that a user can sit upon the mattress and lean back against the side rail cushion 12. Once the cover and cushion ensemble 10 has been attached to the hospital bed, additional pillows having the same or a different decorative appearance may be placed upon the mattress cover 18 to further enhance the aesthetically pleasing appearance of the ensemble 10.

It is important to mention at this juncture that under an alternative embodiment, not shown, where both safety side rails of the bed are in the lowered position or where the bed has no such rails, the head board cover 14, foot board cover 16 and mattress cover 18 may be assembled to the bed 21 without use of the side rail cushion 12 to convert the bed's appearance from that of a hospital bed into that of a decorative covered seat or bench that is aesthetically pleasing and more suited for placement in the home. Stated differently, under this alternative embodiment, neither the side rail cushion 12 nor the side rail cover 20 are utilized.

As previously stated, the various components of the ensemble 10 are arranged for covering the various parts of an otherwise unattractive hospital bed so as to convert the bed's appearance from that of a hospital bed into that of a sofa or some other covered seat that is aesthetically pleasing and more suited for placement in the home. When the cover and cushion ensemble has been applied in this manner, it presents a neat appearance on a hospital bed, giving the effect and use of conventional upholstered furniture found in a home. The attachment of the various components of the ensemble is accomplished in only a few minutes, yet is secure and without wrinkles. Skill and training is not required in attaching the various components of the ensemble to the hospital bed.

The various components of the ensemble 10 may be formed of any suitable flexible fabric or cloth material such as those typically used in fabricating conventional blankets and comforters, e.g., a quilted cotton material, a synthetic material, or a material comprising a blend of cotton and synthetic materials. Moreover, it is preferable that the fabric or cloth be formed of a material that is washable in a conventional home washer and dryer or is treated with a material that facilitates easy wiping away of stains such as those caused by spilled liquid medicines. Also, it is preferable that the fabric comprises a printed, embroidered, or otherwise decorative exterior surface having a pattern or color suitable to the decor of the room or the taste of the owner.

Referring now to FIGS. 9 and 10, in the event it is desired to use the hospital bed for its intended purpose, i.e., providing a level support surface on which a patient sleeps, the ensemble 10 may be used to provide the bed with an aesthetically pleasing appearance. In this manner, the mattress cover 18 is removed and the side rail cushion 12 is flipped over the top of the safety side rail 22 so that the cushion 12 goes from being positioned on the inside of the safety side rail 22 atop the mattress 28 to hanging on the outside of the safety side rail 22. Because the side rail cushion 12 is attached to the upper rail of the safety side rail 22 by means of the fabric strips 30, the side rail cushion 12 actually remains attached to the outside of the safety side rail 12 after the cushion has been flipped thereover. Next, the safety side rail 23 is raised from its lowered position and the side rail cover 20 is placed over safety side rail 23.

The side rail cover 20 is formed of a multi-panel construction including an outer panel and an inner panel which are held together along their respective edges by stitching. The panels are sized slightly larger than the width of the side rail 23 to provide a snug fit of the side rail cover 20 over the side rail 23 hospital bed. The side rail cover 20 is formed of any suitable cushioning material such as that used in fabricating a mattress cover. The cushioned side rail cover 20 serves to protect a patient lying in the bed against suffering injuries or bruises to his or her limbs that would otherwise result from hitting against the side rail 23 such as where the patient experiences convulsions or seizures.

As best shown in FIGS. 2, 3, 7, 9 and 10, a cushioned flap 31 is attached to the side rail cushion 12 by any suitable means, e.g., sewing. When the side rail cushion 12 is positioned to the inside of the safety side rail 22 as shown in FIGS. 2 and 7, the cushioned flap 31 extends downwardly towards the floor. When the side rail cushion 12 is positioned to the outside of the safety side rail 22 as shown in FIGS. 9 and 10, the cushioned flap 31 extends along the inside of the safety side rail 22. The cushioned flap 31 serves the same protective purpose as does the side rail cover 20.

It should be understood that the fastening systems, e.g., VELCRO, described herein are pressure-engagable and will resist shear force and are tension-releasable so that they are readily separable by pulling them apart to enable quick assembly and disassembly of the ensemble 10 to and from the hospital bed.

Without further elaboration the foregoing will so fully illustrate my invention that others may, by applying current or future knowledge, adapt the same for use under various conditions of service.

I claim:

1. In a cover and cushion ensemble, a group of decorative elements for use on a hospital bed to convert the hospital bed into a sofa or some other covered seat that is aesthetically pleasing and suited for placement in the home, the hospital bed having a head board, a foot board, a mattress and first and second opposed safety side rails, each of said first and second safety side rail being moveable between a lowered position and a raised position, both said safety side rails being moved to the raised position when the hospital bed is to be utilized as a bed and the first safety side rail being moved to the lowered position and the second safety side rail being moved to the raised position when the hospital bed is to be utilized as a sofa, said decorative elements comprising:

(a) a side rail cushion being formed of a flexible sheet material and for being releasably secured to the second safety side rail by a fastening means, said side rail cushion for being positioned at a first position adjacent the inside of the second safety side rail when the second side rail is in the raised position to hide the second safety side rail from view when the hospital bed is being utilized as a sofa, said side rail cushion for being moveable from said first position to a second position adjacent the outside of said second safety side rail when the hospital bed is to be utilized as a bed;

(b) a head board cover formed of a flexible sheet material and arranged for fitting over the head board when the hospital bed is to be utilized as a sofa and when the hospital bed is to be utilized as a bed, said head board cover additionally comprising fastening means secured thereto;

(c) a foot board cover formed of a flexible sheet material and arranged for fitting over the foot board when the hospital bed is to be utilized as a sofa and when the hospital bed is to be utilized as a bed, said foot board cover additionally comprising fastening means secured thereto;

(d) a mattress cover formed of a flexible sheet material and arranged for fitting over the mattress when the hospital bed is to be utilized as a sofa, said mattress cover arranged for removal therefrom when the hospital bed is to be utilized as a bed, said mattress cover additionally comprising a front skirt panel extending downwardly therefrom, said front skirt panel comprising flaps at opposed ends that extend laterally, each said flap comprising a fastening means secured thereto for removably engaging said fastening means secured to said head board cover and said foot board cover to provide a unitary and continuous appearance; and, (e) a side rail cover formed of a flexible sheet material and arranged for fitting over the first safety side rail when in the raised position when the hospital bed is to be utilized as a bed, said side rail cover being arranged for removal therefrom when the first safety side rail is moved to the lowered position and the hospital bed is to be utilized as a sofa.

2. The decorative elements of claim 1 wherein said side rail cushion is provided for being moveable from the first position adjacent the inside of the raised safety side rail to the second position adjacent the outside of the raised safety side rail while remaining releasably secured to the raised safety side rail.

3. The decorative elements of claim 1 wherein the first safety side rail is formed of at least one bar extending horizontally and said fastening means comprises a plurality of fabric mounting straps for releasable attachment to said side rail cushion, each strap being arranged for surrounding the at least one horizontal bar of the safety side rail to enable releasable attachment of said side rail cushion to the raised safety side rail.

4. The decorative elements of claim 1 wherein said side rail cushion resembles a large pillow case comprising a closed and an open opposite end for the insertion of pillows therein.

5. The decorative elements of claim 2 wherein said fastening means provided on said head board cover, said foot board cover and said mattress cover are cooperating hook and loop components to enable fastening of said head board cover and said foot board cover to said mattress cover.

6. The decorative elements of claim 5 wherein said head board cover comprises an outer panel and an inner panel, said fastening means being secured to said outer panel.

7. The decorative elements of claim 6 wherein said foot board cover comprises an outer panel and an inner panel, said fastening means being secured to said outer panel.

8. The decorative elements of claim 1 wherein said head board cover is arranged to fit snugly over the head board.

9. The decorative elements of claim 1 wherein said foot board cover is arranged to fit snugly over the foot board.

* * * * *